US008800851B1

(12) United States Patent
Wilks

(10) Patent No.: US 8,800,851 B1
(45) **Date of Patent: *Aug. 12, 2014**

(54) CONTAINER SYSTEM

(76) Inventor: Leroy C. Wilks, Sarasota, FL (US)

( * ) Notice: Subject to any disclaimer, the term of this patent is extended or adjusted under 35 U.S.C. 154(b) by 1241 days.

This patent is subject to a terminal disclaimer.

(21) Appl. No.: 12/283,735

(22) Filed: Sep. 15, 2008

Related U.S. Application Data

(63) Continuation-in-part of application No. 11/974,379, filed on Oct. 12, 2007, now abandoned.

(51) Int. Cl.
*B65D 5/00* (2006.01)

(52) U.S. Cl.
USPC ..... 229/116; 229/107; 206/436

(58) Field of Classification Search
USPC ..... 229/115, 116, 107; 206/436, 551; 434/96, 211, 403
See application file for complete search history.

(56) References Cited

U.S. PATENT DOCUMENTS

| | | | | |
|---|---|---|---|---|
| 4,492,723 | A * | 1/1985 | Chadwick, II | 428/7 |
| 4,834,552 | A * | 5/1989 | Makowka | 383/5 |
| 5,364,017 | A * | 11/1994 | Bennett | 229/107 |
| 5,582,343 | A * | 12/1996 | Dalvey | 229/101 |
| 5,895,306 | A * | 4/1999 | Cunningham | 446/108 |
| 6,309,716 | B1 * | 10/2001 | Fisher et al. | 428/33 |
| 6,652,347 | B1 * | 11/2003 | Stevkovski | 446/102 |

* cited by examiner

*Primary Examiner* — Gary Elkins
*Assistant Examiner* — Christopher Demeree

(57) ABSTRACT

A plurality of circular components each having an interior and exterior surface with a circular periphery at a common radius. Each component is fabricated of a flexible sheet material. Three non-contiguous segments are on each component designating reception areas. Three non-contiguous segments are circumferentially intermediate the reception areas designating coupling areas. An adhesive is on each of the three coupling areas of each component. A majority of the coupling areas is in joining contact with reception areas of adjacent components. A minority of the coupling areas is initially out of contact with reception areas to create a chamber with an opening. A minority of the coupling areas is adapted to be adhesively coupled with a minority of the reception area to thereby create a three dimensional container system with six adhesively coupled areas for each component.

1 Claim, 6 Drawing Sheets

FIG 1
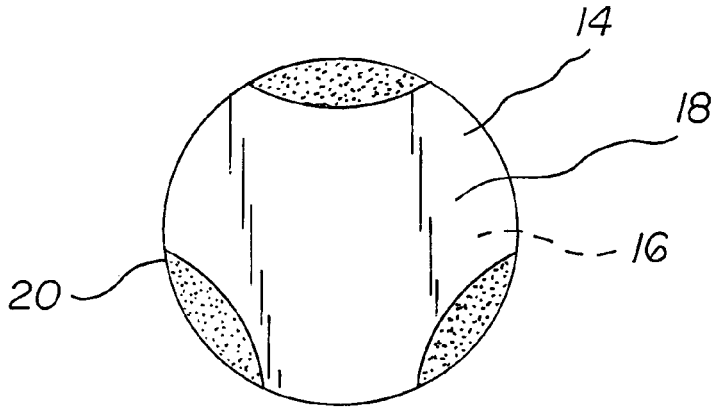
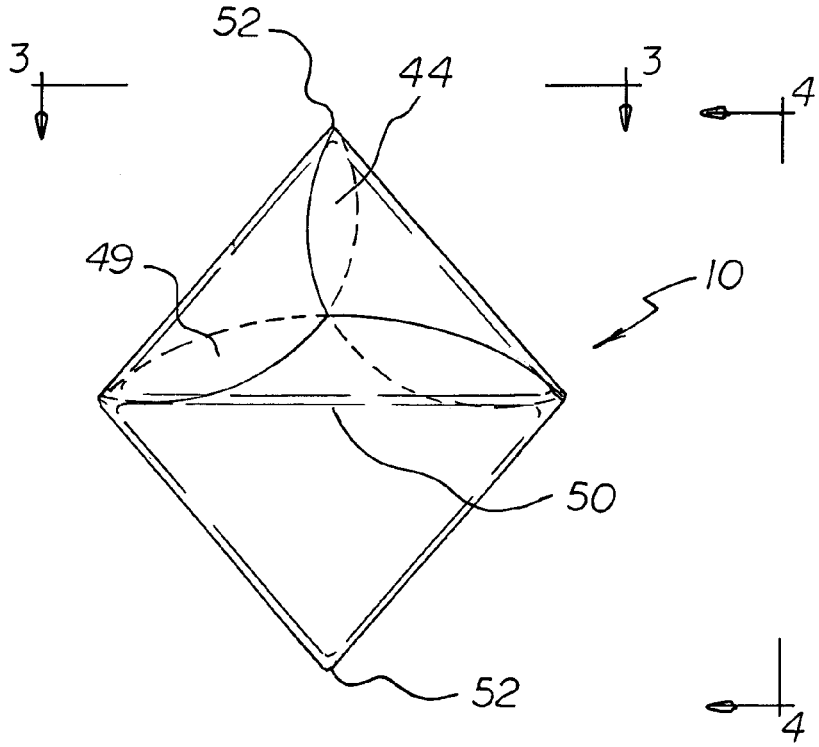
FIG 2

FIG 3
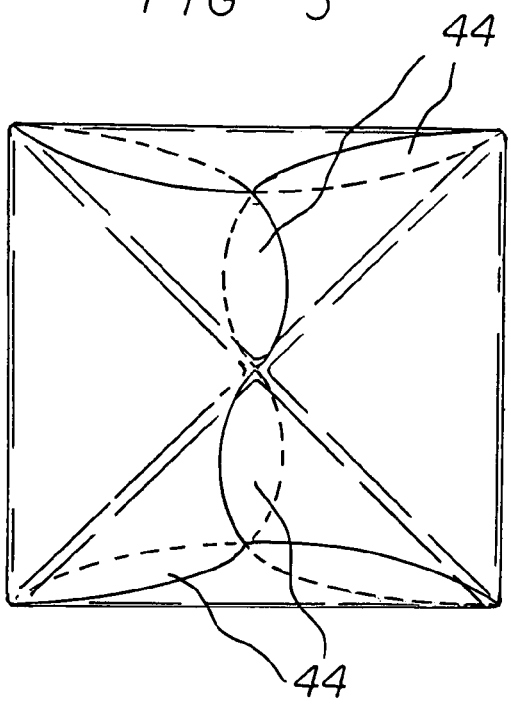
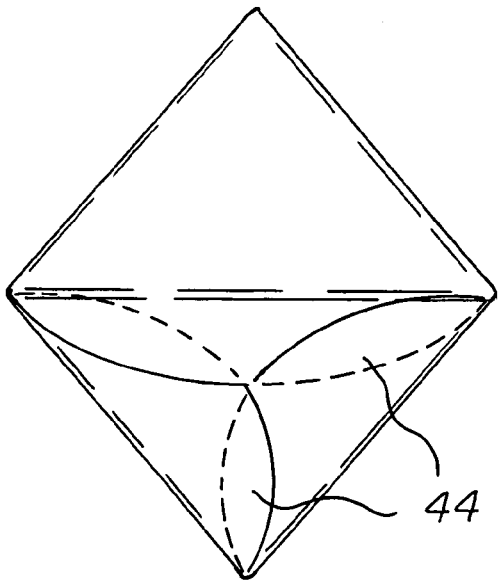
FIG 4

FIG 5
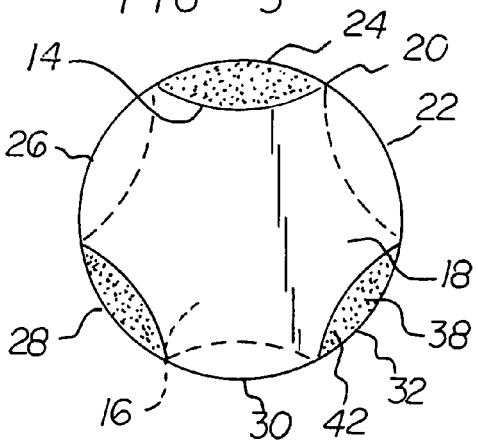
FIG 6
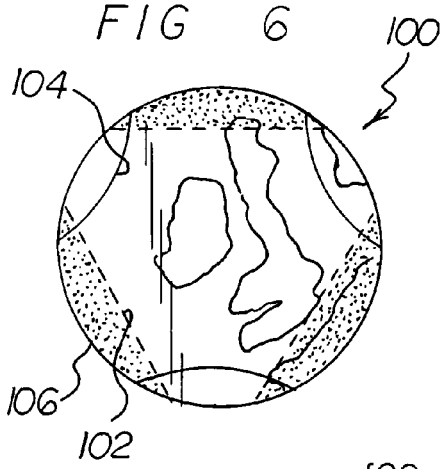
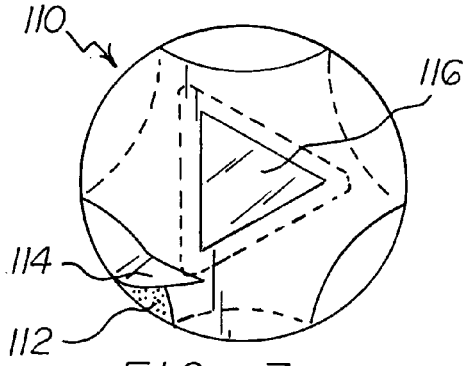
FIG 7
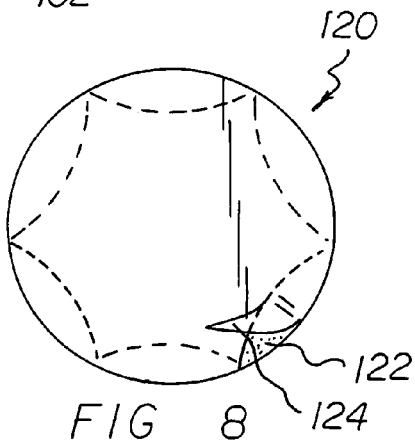
FIG 8
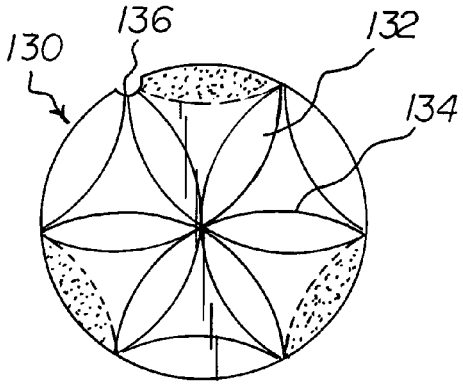
FIG 9
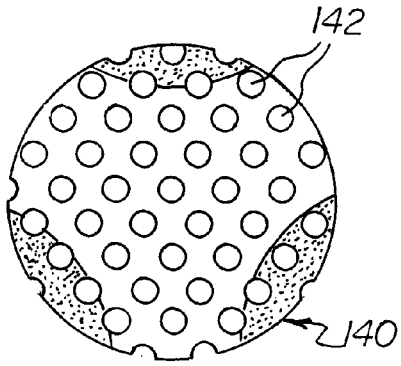
FIG 10

FIG 13
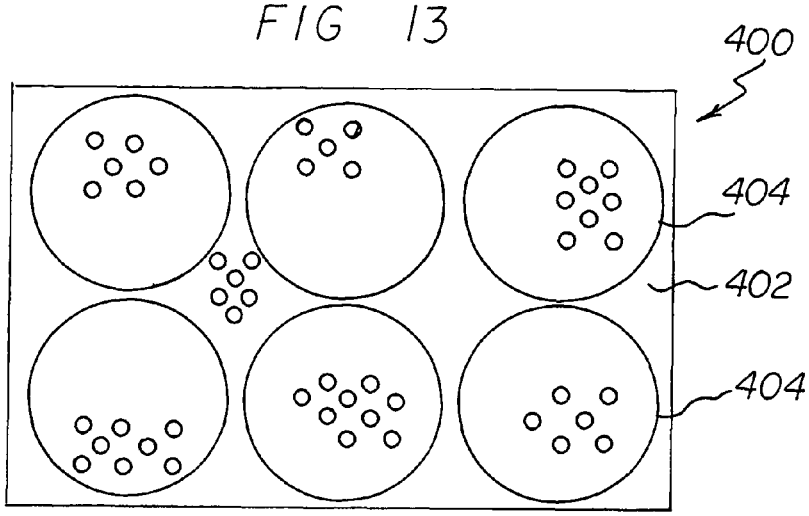
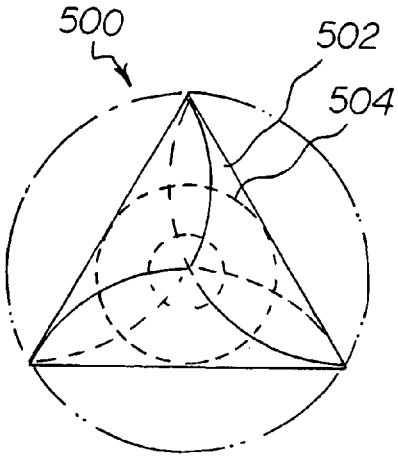
FIG 14
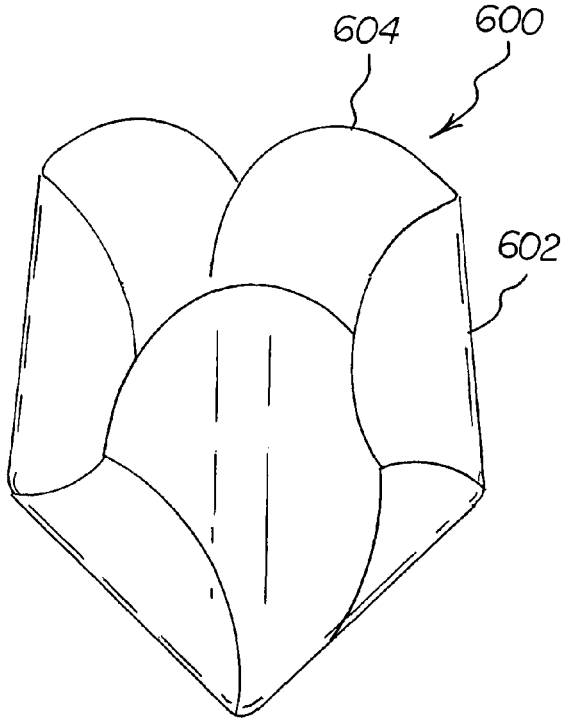
FIG 15

FIG 16
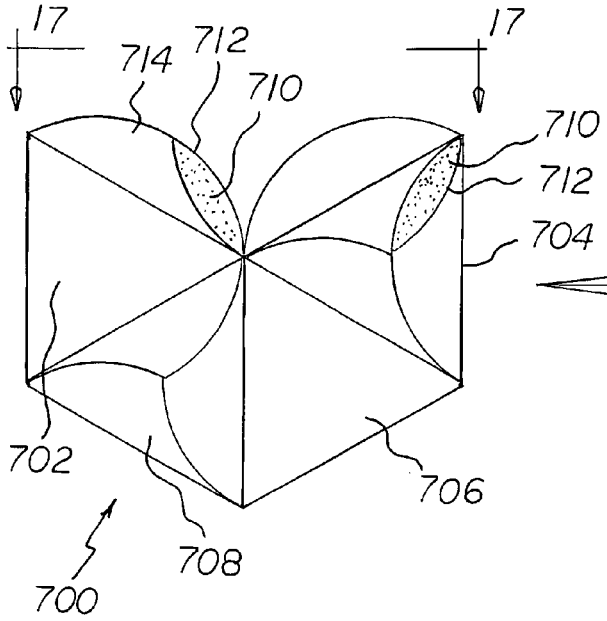
FIG 17
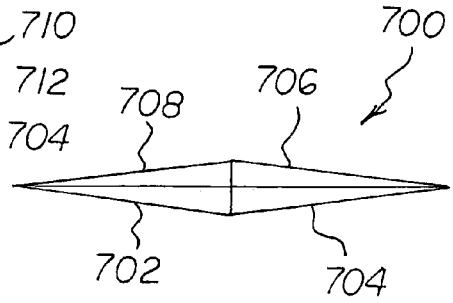
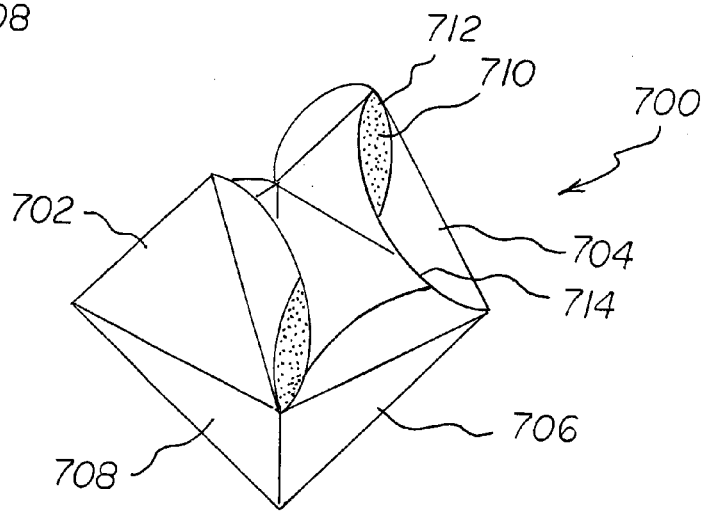
FIG 18

CONTAINER SYSTEM

RELATED APPLICATION

The present application is a continuation-in-part of pending U.S. patent application Ser. No. 11/974,379 filed Oct. 12, 2007 now abandoned, the subject matter of which application is incorporated herein by reference.

BACKGROUND OF THE INVENTION

1. Field of the Invention

The present invention relates to a container system and more particularly pertains to construction of a plurality of similarly configured components and forming generally octahedron shaped containers in a convenient and economical manner.

2. Description of the Prior Art

Methods and apparatuses for constructing components through known methods and apparatuses are known to consist basically of familiar, expected, and obvious structural configurations, notwithstanding the myriad of designs encompassed by the crowded prior art which has been developed for the fulfillment of countless objectives and requirements.

In this respect, the apparatus for constructing components through known methods and apparatuses according to the present invention substantially departs from the conventional concepts and designs, and in doing so provides an apparatus primarily developed for the purpose of construction of a plurality of similarly configured components and forming generally octahedron shaped containers in a convenient and economical manner.

Therefore, it can be appreciated that there exists a continuing need for a new and improved method and apparatus for construction of a plurality of similarly configured components and forming generally octahedron shaped containers in a convenient and economical manner. In this regard, the present invention substantially fulfills this need.

SUMMARY OF THE INVENTION

In view of the foregoing disadvantages inherent in the known types of building systems of known designs and configurations now present in the prior art, the present invention provides an improved three dimensional building system. As such, the general purpose of the present invention, which will be described subsequently in greater detail, is to provide a new and improved three dimensional building system and method which has all the advantages of the prior art and none of the disadvantages.

To attain this, the present invention essentially comprises a container system constructed of a plurality of similarly configured components. The components are adapted to form a generally octahedron shaped container for objects. The container system is in a convenient, attractive and economical manner. First provided are four components. Each of the components has a front surface and a rear surface with a circular periphery at a common radius. Each of the components has six contiguous segments which constitute a unique 60 degrees of the periphery. Each of the components is fabricated of card stock paper with a coating.

Next provided are three non-contiguous segments on the front surface, each such segment has an arcuate first edge designating three similarly sized and shaped reception areas. Each first edge having a radius of curvature equal to the radius of the circular periphery.

Next provided are three additional non-contiguous segments on the rear surface, each such segment is circumferentially intermediate the three non-contiguous reception areas of the front surface. Each such segment has an arcuate second edge designating three similarly sized and shaped coupling areas. Each second edge has a radius of curvature equal to the radius of the circular periphery.

An adhesive is provided on each of the three coupling areas of each component. Eight coupling areas are in joining contact with eight reception areas of three different adjacent components. Eight reception areas are in joined contact with eight coupling areas of three different adjacent components. A container is thereby formed with an open top for receiving an object. The components are adapted to be creased and maintained in a flat orientation prior to the minority of the coupling areas being adhesively coupling to reception areas. Each coupling area is covered by a peel strip, the peel strip being adapted to be removed to expose the adhesive prior to use.

The remaining four coupling areas and the remaining four reception areas when joined form a generally octahedron shaped container. Such octahedron shaped container has two similarly configured pyramids. Each such pyramid has four similarly sized and shaped equilateral triangles with a square base and with the square bases of the pyramids constituting a common medial plane. Each pyramid has an apex equally spaced from the median plane.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved three dimensional building system which has all of the advantages of the prior art building systems of known designs and configurations and none of the disadvantages.

It is another object of the present invention to provide a new and improved three dimensional building system which may be easily and efficiently manufactured and marketed.

It is further object of the present invention to provide a new and improved three dimensional building system which is of durable and reliable constructions.

An even further object of the present invention is to provide a new and improved three dimensional building system which is susceptible of a low cost of manufacture with regard to both materials and labor, and which accordingly is then susceptible of low prices of sale to the consuming public, thereby making such three dimensional building system economically available to the buying public.

Even still another object of the present invention is to provide a three dimensional building system for construction of a plurality of similarly configured components and forming generally octahedron shaped containers in a convenient and economical manner.

Lastly, it is an object of the present invention to provide a new and improved container system. The system includes a plurality of circular components each having an interior and exterior surface with a circular periphery at a common radius. Each component is fabricated of a flexible sheet material. Three non-contiguous segments are on each component designating reception areas. Three non-contiguous segments are circumferentially intermediate the reception areas designating coupling areas. An adhesive is on each of the three coupling areas of each component. A majority of the coupling areas is in joining contact with reception areas of adjacent components. A minority of the coupling areas is initially out of contact with reception areas to create a chamber with an opening. A minority of the coupling areas is adapted to be adhesively coupled with a minority of the reception area to thereby create a three dimensional container system with six adhesively coupled areas for each component. These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a circular building component constructed in accordance with the principles of the present invention.

FIG. 2 is a front elevational view of a three dimensional building system constructed of four circular building components in accordance with the principles of the present invention.

FIG. 3 is a plan view of the three dimensional building system taken along line 3-3 of FIG. 2.

FIG. 4 is a side elevational view of the three dimensional building system taken along line 4-4 of FIG. 2.

FIG. 5 is a rear elevational view of the circular building component illustrated in FIG. 1.

FIG. 6 is a front elevational view of a circular building component with map markings constructed in accordance with an alternate embodiment of the invention.

FIG. 7 is a rear elevational view of a circular building component with peel strips and a transparent region constructed in accordance with an alternate embodiment of the invention.

FIG. 8 is a rear elevational view of a circular building component with a two layer composition constructed in accordance with an alternate embodiment of the invention.

FIG. 9 is a front elevational view of a circular building component with geometric design markings constructed in accordance with an alternate embodiment of the invention.

FIG. 10 is a front elevational view of a circular building component with apertures constructed in accordance with an alternate embodiment of the invention.

FIG. 13 is a front elevational view of components coupled through a panel constructed in accordance with an alternate embodiment of the invention.

FIG. 14 is a perspective illustration of a building system functioning as a package constructed in accordance with an alternate embodiment of the present invention.

FIG. 15 is a perspective illustration of a building system adapted to function as a package with one side open constructed in accordance with an alternate embodiment of the present invention.

FIG. 16 is a front elevational view of a container system constructed in accordance with the primary embodiment of the invention.

FIG. 17 is a plan view of taken along line 17-17 of FIG. 16.

FIG. 18 is a front elevational view of the container system illustrated in FIG. 16 but with the container system tipped.

The same reference numerals refer to the same parts throughout the various Figures of the various alternate embodiments of the invention.

DESCRIPTION OF THE PREFERRED EMBODIMENT

Figure 11:
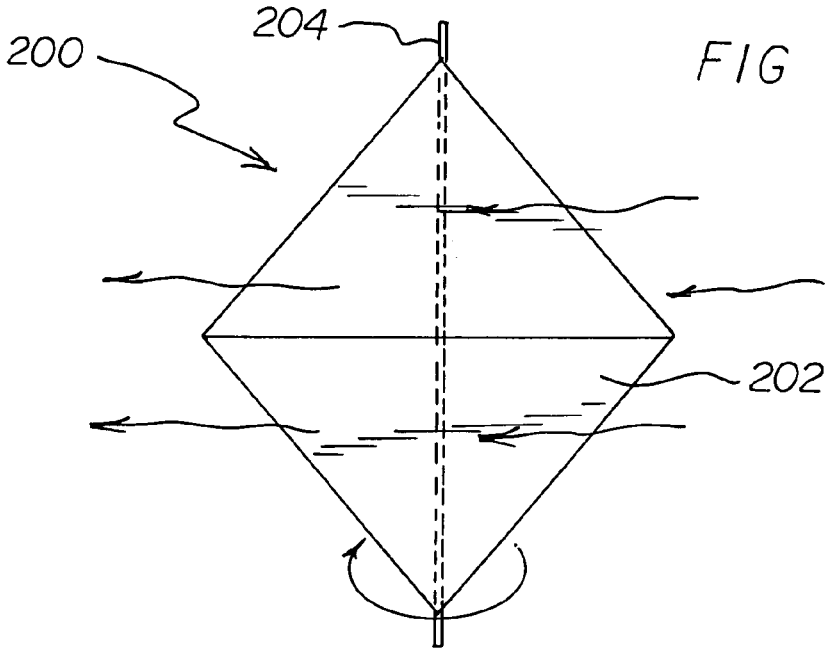
FIG. 11 is a perspective illustration of a building system adapted to spin constructed in accordance with an alternate embodiment of the present invention.

With reference now to the drawings, and in particular to FIG. 1 thereof, the preferred embodiment of the new and improved three dimensional building system embodying the principles and concepts of the present invention and generally designated by the reference numeral 10 will be described.

The present invention, the three dimensional building system 10 is comprised of a plurality of components. Such components in their broadest context include a plurality of circular components, and a coupler. Such components are individually configured and correlated with respect to each other so as to attain the desired objective.

First provided are four components 14. Each of the components has a front surface 16. Each of the components has a rear surface 18. Each of the components has a circular periphery 20 at a common radius. Each of the components has six contiguous segments 22, 24, 26, 28, 30 and 32. Each of the segments constitutes a unique 60 degrees of the periphery. Each of the components is fabricated of a flexible sheet material. The flexible sheet material is preferably paper.

Three non-contiguous segments 22, 26, 30 are provided on the front surface. An arcuate first line 34 is provided. The arcuate first line designates three similarly sized and shaped reception areas 36. Each first line has a radius of curvature equal to the radius of the circular periphery. Although illustrated herein with a broken line, such line to designate the reception areas is preferably imaginary or non-visible in the preferred embodiment.

Three non-contiguous segments 24, 28, 32 are provided on the rear surface. The three non-contiguous segments provided on the rear surface are provided circumferentially intermediate the three non-contiguous reception areas of the front surface. An arcuate second line 36 is provided. The arcuate second line designates three similarly sized and shaped adhesive areas 38. Each second line has a radius of curvature equal to the radius of the circular periphery.

Provided next is an adhesive coupler 42. The adhesive coupler is provided on each of the three adhesive areas of each component. The three adhesive areas are in joining contact with the reception areas of three different adjacent components. The reception areas of each component are in joined contact with the adhesive areas of three different adjacent components. In this manner six junction areas 44 are created for each component.

In this manner the four components form a generally octahedron shaped object from two similarly configured pyramids. Each pyramid has four similarly sized and shaped equilateral triangles. Each pyramid has a square base. The square bases of the pyramids constitute a common medial plane 50. Each pyramid has an apex 52. The apex is equally spaced from the median plane.

An alternate embodiment of the present invention is show in FIG. 6. Each reception area of each component 100 is on the front surface. Each reception area is bounded by a linear first line 104. The linear first line has a common length. Each coupling area is on the rear surface. Each coupling area is bounded by a second line 102. The second line has a common length. The common length of the second lie is equal to the length of the first lines. The coupler is an adhesive 106. Indicia 108 is provided. The indicia is provided the front surface in the nature of a map segment.

Another alternate embodiment of the present invention is shown in FIG. 7. Each reception area of each component 110 is on the front surface. The first line has a radius of curvature. The radius of curvature of the first line is equal to the radius of the circular periphery. Each coupling area is on the rear surface. Each coupling area is bounded by a second line. The second line has a radius of curvature. The radius of curvature of the second line is equal to the radius of the circular periphery. The coupler is an adhesive 112. The adhesive is covered by a peel strip 114. The peel strip is adapted to be removed. In this manner the adhesive is exposed prior to use.

The embodiment of FIG. 7 also is formed with a transparent, preferably plastic, window 116 in one component. Such component is formed to include an opening of a shape similar to the window. The window is positioned to fill the opening. Such window has a periphery slightly greater than the periphery of the opening so as to allow coupling the window to the component, preferably by an adhesive. Any of a wide variety of shapes are adapted to by utilized for the opening and window. This embodiment allows the system to be utilized as a package with the contents of the package readily visible through the window.

Another alternate embodiment of the present invention is shown in FIG. 8. Each reception area of each component 120 is on the front surface. Each reception area is bounded by a first line. The first line has radius of curvature. The radius of curvature of the first line is equal to the radius of the circular periphery. Each coupling area is on the rear surface. Each coupling area is bounded by a second line formed as a score line. The second line has a radius of curvature. The radius of curvature of the second line is equal to the radius of the circular periphery. The coupler includes a base-layer. The coupler also includes a cover-layer. An adhesive 122 is provided. The adhesive is provided between the base-layer and a cover-layer. A peel strip 124 is provided. The peel strip is defined by the score line. The peel strip is adapted to be removed. In this manner the adhesive is exposed prior to use.

Another alternate embodiment of the present invention is shown in FIG. 9. Each reception area of each component 130 is on the front surface. Each reception are is bounded by a first line. The first line has a radius of curvature. The radius of curvature of the first line is equal to the radius of the circular periphery. Each coupling area is on the rear surface. Each coupling area is bounded by a second line. The second line has a radius of curvature. The radius of curvature of the second line equal to the radius of the circular periphery. The coupler is an adhesive. The components are fabricated of a transparent material 132. Additionally, indicia 134 are provided. The indicia are provided on the front surface. Another additional feature of this embodiment is a notch 136 at one location on the periphery. When the system is configured into a three dimensional building system with such component, the notch creates an area for viewing the interior of the system and any contents within the system.

An alternate embodiment of the present invention is shown in FIG. 10. The system further includes a plurality of apertures 142 over the entire surface of each component 140. This embodiment, like the embodiment of FIG. 7, allows the system to be utilized as a package with the contents of the package readily visible through the apertures. This embodiment, unlike the embodiment of FIG. 7, also allows the system to be utilized as a scent dispenser with an interior aromatic material such as a perfume or an insecticide or the like being operative through the apertures.

Another alternate embodiment is shown in FIG. 11. A generally octahedron shaped object 202 is formed from two similarly configured pyramids. Each pyramid has four similarly sized and shaped equilateral triangles. Each pyramid has a square base. The square bases of the pyramids constitute a common medial plane. Each pyramid has an apex. The apexes of the pyramids are equally spaced from the median plane. The system further includes a linear axis 204. The linear axis extends through the object. The linear axis extends from apex to apex and beyond. The axis supports the object. In this manner wind may rotate the object.

Figure 12:
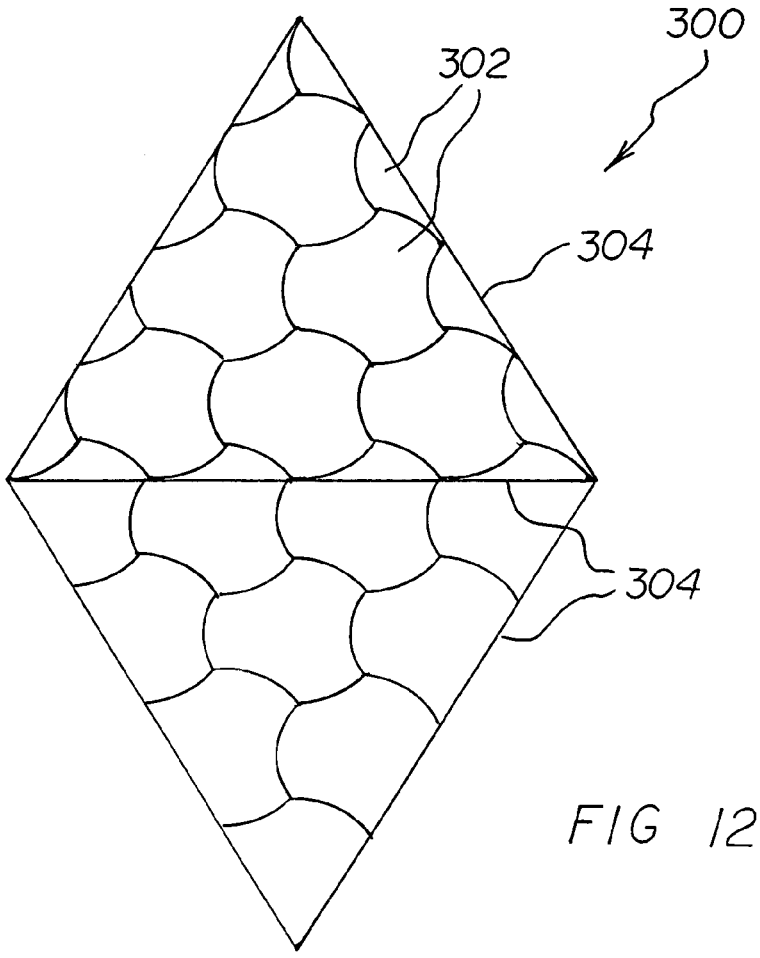
FIG. 12 is a perspective illustration of an enlarged building system constructed in accordance with another alternate embodiment of the present invention.

The next alternate embodiment of the present invention is shown in FIG. 12. The generally octahedron shaped object is formed of sixty-four components 302. Various numbers of components are adapted to be used in constructing systems of various sizes.

FIG. 13 is a front elevational view of components coupled through a panel constructed in accordance with a further alternate embodiment of the invention. The system 400 includes a panel 402 with a plurality of components 404 integrally formed in the panel. Each of the components is adapted to be separated from the panel for use in constructing a three dimensional building system. Score lines around the periphery of each component facilitate the separation of the components from the panel.

FIG. 14 is a perspective illustration of a building system functioning as a package constructed in accordance with an alternate embodiment of the present invention. The system 500 is a package 502. The system further includes an object 504 such as a CD, a compact disk, within the package.

In FIG. 15 there is shown a perspective illustration of a building system 600 adapted to function as a package 602. In such system, one side 604 is open. After introducing an object into the system, the open side is adapted to be sealed as by an adhesive to complete the packaging of the object.

The final alternate embodiment is a container system 700 which constitutes the preferred embodiment of the invention. Shown in FIGS. 16, 17 and 18 is a container system constructed of a plurality of similarly configured components 702, 704, 706 and 708. The components are adapted to form a generally octahedron shaped container for objects. The container system is in a convenient, attractive and economical manner. First provided are four components. Each of the components has a front surface and a rear surface with a circular periphery at a common radius. Each of the components has six contiguous segments which constitute a unique 60 degrees of the periphery. Each of the components is fabricated of card stock paper with a coating.

Next provided are three non-contiguous segments on the front surface, each such segment has an arcuate first edge designating three similarly sized and shaped reception areas 714. Each first edge having a radius of curvature equal to the radius of the circular periphery.

Next provided are three additional non-contiguous segments on the rear surface, each such segment is circumferentially intermediate the three non-contiguous reception areas of the front surface. Each such segment has an arcuate second edge designating three similarly sized and shaped coupling areas 710. Each second edge has a radius of curvature equal to the radius of the circular periphery.

An adhesive 710 is provided on each of the three coupling areas of each component. Eight coupling areas are in joining contact with eight reception areas of three different adjacent components. Eight reception areas are in joined contact with eight coupling areas of three different adjacent components. A container is thereby formed with an open top for receiving an object. The components are adapted to be creased and maintained in a flat orientation prior to the minority of the coupling areas being adhesively coupling to reception areas. Each coupling area is covered by a peel strip 712, the peel strip being adapted to be removed to expose the adhesive prior to use.

The remaining four coupling areas and the remaining four reception areas when joined form a generally octahedron shaped container. Such octahedron shaped container has two similarly configured pyramids. Each such pyramid has four similarly sized and shaped equilateral triangles with a square base and with the square bases of the pyramids constituting a common medial plane. Each pyramid has an apex equally spaced from the median plane.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container system constructed of a plurality of similarly configured components adapted to form a generally octahedron shaped container for objects, the container system being in a convenient, attractive and economical manner comprising, in combination:

four components that are circles, each of the components having a front surface and a rear surface with a completely circular periphery at a common radius, each of the components having six contiguous segments, each of the segments constituting a unique 60 degrees of the periphery, each of the components being fabricated of card stock paper with a coating;

three non-contiguous segments on the front surface with an arcuate first edge designating three similarly sized and shaped reception areas, each first edge having a radius of curvature equal to the radius of the circular periphery, all of the reception areas and all of the coupling area being of the same size and same shape;

three additional non-contiguous segments on the rear surface circumferentially intermediate the three non-contiguous reception areas of the front surface with an arcuate second edge designating three similarly sized and shaped coupling areas, each second edge having a radius of curvature equal to the radius of the circular periphery; and an adhesive on each of the three coupling areas of each component with eight coupling areas in joining contact with eight reception areas of three different adjacent components and with eight reception areas in joined contact with eight coupling areas of three different adjacent components to thereby form a container with an open top for receiving an object, the components adapted to be creased and maintained in a flat orientation prior to the minority of the coupling areas being adhesively coupling to reception areas, each coupling area is covered by a peel strip, the peel strip being adapted to be removed to expose the adhesive prior to use;

whereby the remaining four coupling areas and the remaining four reception areas when joined form a generally octahedron shaped container from two similarly configured pyramids, each pyramid having four similarly sized and shaped equilateral triangles with a square base and with the square bases of the pyramids constituting a common medial plane and with each pyramid having an apex equally spaced from the median plane.

* * * * *